US007044229B2

(12) United States Patent
Tennøy et al.

(10) Patent No.: US 7,044,229 B2
(45) Date of Patent: May 16, 2006

(54) DOWNHOLE VALVE DEVICE

(76) Inventors: Andor Svein Tennøy, Nymannsveien 147A, Stavanger (NO) N-4015; Bernt Reinhardt Pedersen, Johan Thorsensg. 62, Stavanger (NO) N-0775

( * ) Notice: Subject to any disclaimer, the term of this patent is extended or adjusted under 35 U.S.C. 154(b) by 217 days.

(21) Appl. No.: 10/380,673

(22) PCT Filed: Sep. 28, 2001

(86) PCT No.: PCT/NO01/00396

§ 371 (c)(1),
(2), (4) Date: Jun. 30, 2003

(87) PCT Pub. No.: WO02/29200

PCT Pub. Date: Apr. 11, 2002

(65) Prior Publication Data

US 2005/0098351 A1 May 12, 2005

(51) Int. Cl.

| | |
|---|---|
| ***E21B 23/00*** | (2006.01) |
| ***E21B 34/06*** | (2006.01) |
| ***E21B 21/10*** | (2006.01) |
| ***E21B 17/18*** | (2006.01) |
| ***E21B 44/00*** | (2006.01) |

(52) U.S. Cl. ..... 166/373; 166/66.6; 166/320; 166/386; 175/38; 175/48; 175/320

(58) Field of Classification Search ..... 166/373, 166/374, 381, 386, 317, 319, 320, 65.1, 66, 166/66.6; 175/24, 25, 38, 40, 48, 57, 215, 175/320; 137/625.28
See application file for complete search history.

(56) References Cited

U.S. PATENT DOCUMENTS

| | | | | | |
|---|---|---|---|---|---|
| 2,805,043 | A | * | 9/1957 | Williams, Jr. | 175/317 |
| 3,411,321 | A | * | 11/1968 | Schurman | 464/183 |
| 3,749,186 | A | * | 7/1973 | Kutuzov et al. | 175/228 |
| 3,805,606 | A | * | 4/1974 | Stelzer et al. | 73/152.48 |
| 3,908,771 | A | * | 9/1975 | Garrett | 175/393 |
| 3,967,680 | A | * | 7/1976 | Jeter | 175/38 |
| 4,076,083 | A | * | 2/1978 | Sizer | 175/65 |
| 4,102,418 | A | * | 7/1978 | Kammerer, Jr. | 175/324 |
| 4,258,801 | A | * | 3/1981 | Poston | 175/65 |
| 4,361,193 | A | * | 11/1982 | Gravley | 175/61 |
| 4,491,738 | A | * | 1/1985 | Kamp | 290/43 |
| 4,615,399 | A | * | 10/1986 | Schoeffler | 175/38 |
| RE32,463 | E | * | 7/1987 | Westlake et al. | 175/48 |
| 4,790,393 | A | | 12/1988 | Larronde et al. | |
| 4,844,182 | A | | 7/1989 | Tolle | |

(Continued)

*Primary Examiner*—Jennifer H. Gay
(74) *Attorney, Agent, or Firm*—Christian D. Abel

(57) ABSTRACT

A downhole valve device (1) in a drill string (14) in a petroleum well (2) and method for maintaining optimal annular fluid velocity and wellbore pressure. The device comprises a valve housing (20) connected between adjacent segments (12, 13) of the drill string. The valve housing is further provided with at least one valve (23) arranged to open and close to the flow of drilling fluid based on measured values of downhole physical parameters or on signals from the surface in order to permit the through-flow of a sufficient volume of drilling fluid necessary to adjust and maintain the annular fluid velocity of the drilling fluid and the wellbore pressure within optimal operating conditions.

5 Claims, 2 Drawing Sheets

U.S. PATENT DOCUMENTS 5,060,737 A * 10/1991 Mohn ..... 175/104
5,065,825 A * 11/1991 Bardin et al. ..... 175/38
5,609,178 A * 3/1997 Hennig et al. ..... 137/10
6,176,311 B1 * 1/2001 Ryan ..... 166/99
2002/0005299 A1 * 1/2002 Estep et al. ..... 175/57
2004/0108138 A1 * 6/2004 Cooper et al. ..... 175/26

* cited by examiner

DOWNHOLE VALVE DEVICE

BACKGROUND OF THE INVENTION-FIELD OF THE INVENTION

This invention relates to a downhole valve to be installed in a drill string, of the kind used for example in the exploration and recovery of petroleum deposits. In particular the invention relates to a downhole valve and method for adjusting and maintaining annular fluid velocity of the drilling fluid within optimal levels.

BACKGROUND OF THE INVENTION-DESCRIPTION OF RELATED ART

In petroleum wells it is common practice to case down to a certain well depth in order, ia., to ensure that the well will not collapse. From the lower end portion of the casing an uncased well section of a smaller diameter is drilled further into the formation. The transition between the casing and the uncased well is commonly referred to as a "shoe", in the following referred to as a "transition shoe". Drilling fluid (mud) is pumped from the surface down the drill string to the drill bit in order to cool and clean it. The drilling fluid returns together with severed cuttings to the surface through the annulus formed between the drill string and the wall of the well. During drilling there is the risk that the cuttings may settle from the drilling fluid and accumulate along the low side of the well profile, which entails the risk of the drill string jamming. It is therefore very important that drilling fluid is supplied in an adequate amount for such settling to be avoided. By settling is meant, in this connection, that particles fall out of a fluid mixture. At the transition shoe between the cased and the uncased part of the well, there is an increase in pipe diameter which makes the drilling fluid flow at a reduced rate because of the cross-sectional increase. Settling of cuttings from the drilling fluid often occurs in this region. In long wells, by high drilling fluid velocity there will also be a considerable flow resistance in the drilling fluid. Therefore, in order to achieve the desired amount of flow, the pump pressure must be increased. However, other drilling-technical conditions set limits to how high or how low a pressure may be used. For example, drilling fluid may enter the well formation by too high a pressure. By to low a pressure the wall of the well may collapse, or well fluid may enter from the well formation into the well, which may result in an uncontrollable drilling situation. A typical well profile penetrates a number of formation strata of different geological properties. The estimated pore pressure and fracture limits of the formations drilled set limits to the specific gravity of the drilling fluid. As longer wells are being drilled, the problems become more pronounced.

The main portion of time loss occurring during drilling may be ascribed to these conditions and other hydraulically related problems, such as they will be described in the following, and to the measures that have to be taken to control them.

According to known technique, the above-mentioned tasks are solved by utilizing a number of different methods and measures. The well pressure is controlled essentially by adjusting the specific gravity, rheological properties and pressures of the drilling fluid.

The settling of cuttings from the drilling fluid may be reduced and hole cleaning improved by increasing the rotational speed of the drill string. The drilling fluid is then drawn along into a rotary motion in addition to the axial movement. This results in a helical flow which causes a higher flow rate because the flow path is longer than by axial movement only. Good cleaning may also be achieved by running the drill string slowly up and down at the same time as drilling fluid is flowing through the well.

When, due to too high pressure, drilling fluid penetrates the well formation, a substance may be added, which will tighten the pores of the well, e.g. crushed nutshell. The specific gravity of the drilling fluid may also, perhaps at the same time, be lowered to reduce the pressure and thereby prevent further fracturing.

In a so-called "kick" gas is flowing from the well formation into the well displacing drilling fluid. This results in more drilling fluid flowing out of the well than being supplied. Such a potential uncontrollable situation is countered by pumping down heavier well fluid into the well. This is a slow process because the gas expands further as it is rising within the well and the hydrostatic pressure is reduced. Circulating gas out from the well may typically take 24 to 48 hours.

The reason for the drawbacks of known technique is primarily that it is difficult and often not possible to adjust the properties of the drilling fluid an such a way that it will meet the most important drilling-technical requirements within the restrictions set by the formation. In longer wells the loss of flow friction of the drilling fluid contributes to the fact that the difference in pressure of the drilling fluid when it is being pumped through the well (total pressure) and when it is not in motion (static pressure) becomes greater. This makes it difficult to keep the well pressure within the limits set by the pore pressure and fracture limit of the formation. Thus, it is not possible to use a total pressure that will provide the desires flow rate in the drilling fluid, which results in increasing settling of cuttings from the drilling fluid, in particular at the transitions between the cased and the uncased well portions.

BRIEF SUMMARY OF THE INVENTION

The invention has as its object to remedy the negative aspects of known technique.

The object is realized according to the invention through the features set forth in the description below and in the subsequent claims.

At a distance from the drill bit, which distance is adjusted in accordance with the well conditions, and which may typically be several hundred meters, one or more downhole valves are installed, which are arranged to direct part of the drilling fluid flowing down through the drill string, out into the annulus between the drill string and the casing/formation wall.

The downhole valve may comprise a valve housing with a built-in valve, a distributor housing and necessary control components. The downhole valve is provided with securing devices complementarily matching the threaded pipe. connections of the drill string, and is secured between adjacent pipe sections. The downhole valve forms an integrated part of the drill string. An axial bore extending through the valve housing allows the drilling fluid to flow freely between the two connected drill pipes through the valve housing. The downhole valve is arranged to open/close a connection between the internal axial bore and an annular distributor housing. When the distributor housing is not installed, the opening opens directly into the annulus around the downhole valve. The distributor housing encircling the valve housing is provided with openings/slots distributed round the periphery of the distributor housing. The opening(s) is (are) arranged to distribute the exiting drilling fluid approximately equally round the downhole valve.

The valve is arranged to open and close during drilling, by means of an actuator and a control system of a kind known in itself. For example, an electric actuator may be controlled to open and close the valve whenever pre-programmed physical parameters are met. Such planters may be well angle and/or well pressure. The valve may be overridden, for example, by the drill string being rotated at specific speeds in a predetermined sequence, or by acoustic communication to the surface.

In a typical drilling situation, in which there is a risk that cuttings will settle from the drilling fluid, in particular at the transition between cased and uncased well, and in which it is not convenient to increase the pump pressure or the specific gravity of the drilling fluid further because of the risk of drilling fluid entering the formation, the valve is opened and a portion of the drilling fluid, which is flowing down the drill string, flows out into the annulus. The flow of drilling fluid in the upper part of the well may thereby be increased without the pressure increasing correspondingly. The velocity of the drilling fluid in the annulus between the drill string and the casing increases and settling of cuttings from the drilling fluid may be prevented.

By unwanted inflow of gas or liquid from the formation into the well, it is possible to open the valve and thereby quickly pump down heavier drilling fluid which then intersects the gas pocket or the formation liquid which is entering the well. Correspondingly, by unwanted outflow of drilling fluid to the formation because of overbalance in the fluid pressure, the downhole valve may be opened and lighter drilling fluid be pumped directly into the annulus above the leakage area to remedy this situation.

BRIEF DESCRIPTION OF THE DRAWINGS

In the following will be described a non-limiting example of a preferred embodiment visualized in the accompanying drawings, in which.

DETAILED DESCRIPTION OF THE INVENTION

Figure 1:
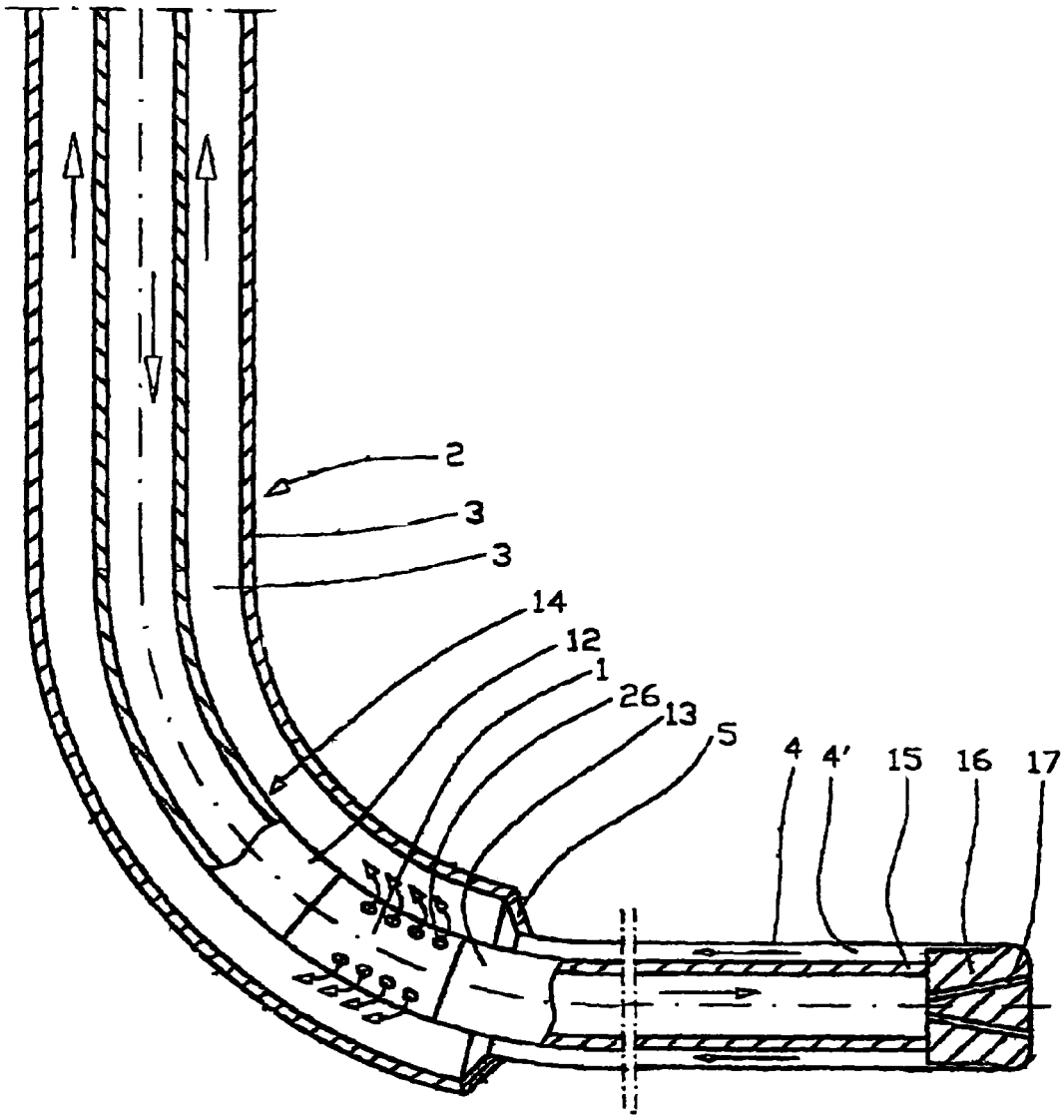
FIG. 1 shows schematically in section a well, in which a drill string, with a downhole valve according to the invention installed, is placed in a well bore.

In the drawings the reference numeral 1 identifies a downhole valve according to the invention, see FIG. 1. In a well 2 a casing 3 has been lowered into the part initially drilled. The casing 3 ensures that the well does not collapse, and thereby forms an appropriate shaft for drilling to be continued into the uncased part 4 of the well. In the transition between the cased and uncased parts of the well is disposed a transition shoe 5 forming a transition between the relatively large diameter of the casing 3 and the smaller diameter of the uncased well part 4. The downhole valve 1 is connected between two drill pipes 12 and 13 and form part of a drill string 14. The downhole valve 1 is built into the drill string 14 at a distance, adjusted according to the well conditions, from the lower end portion 15 of the drill string 14, to which the drill bit 16 is attached.

Figure 2:
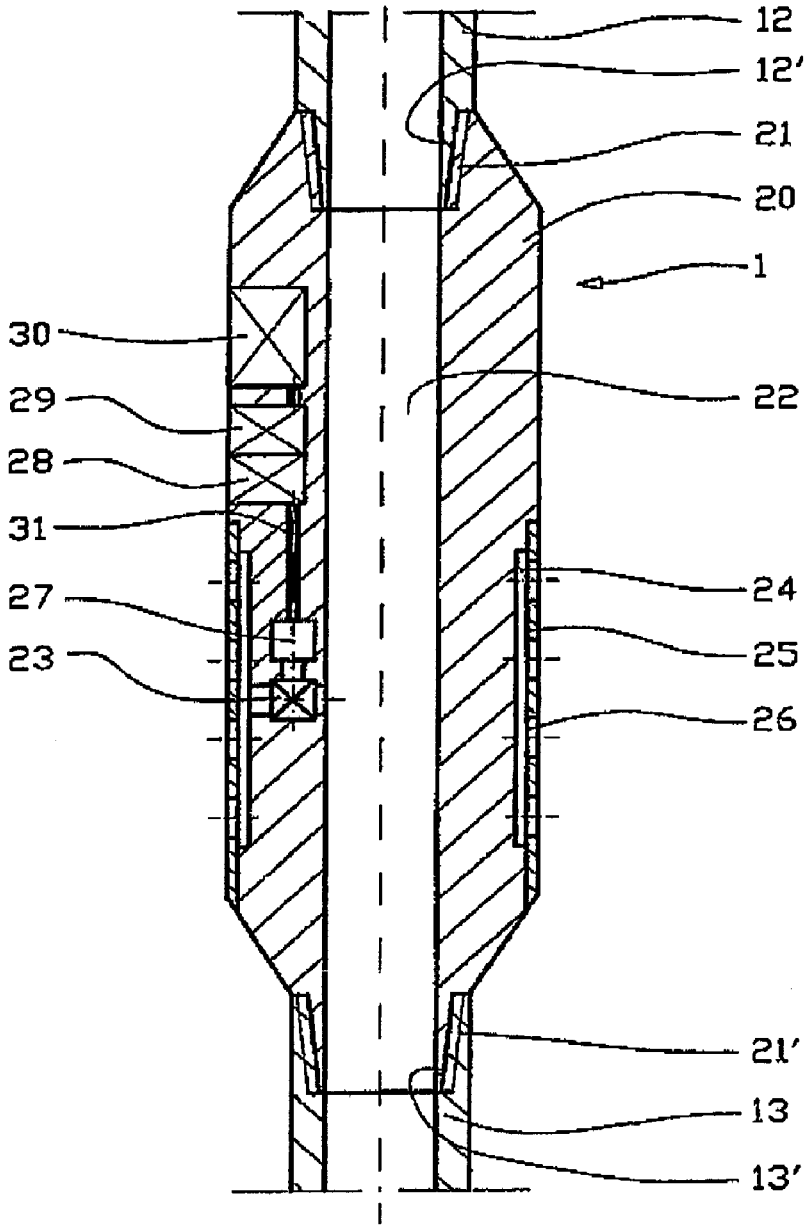
FIG. 2 shows in section and in part schematically a down hole valve in detail.

At its two end portions a valve housing 20 of the downhole valve 1 is provided with securing devices 21, 21' complementarily matching the threaded connectors 12' and 13' of the drill pipe, see FIG. 2. In the valve housing 20 there is a bore 22 extending therethrough and forming a connection between the pipes 12 and 13. A valve 23, which may possibly comprise several valves, is disposed in the valve housing 20 between the bore 22 and an annulus 24 formed between the valve housing 20 and a distributor housing 25. In this connection the valve 23 may possibly comprise several volume flow controlling devices. The periphery of the distributor housing 25 is provided with openings in the form of one ore more holes/slots 26 arranged to distribute the exiting drilling fluid approximately equally round the valve housing 20. The downhole value 1 will also work without the distributor housing 25. The valve 23 is opened and closed by an actuator 27. In a preferred embodiment the actuator 27 is operated electrically by a control device 28, batteries 29, sensors 30 and electrical cables 31. The valve 23, actuator 27 and the electrical control means 28 to 31 are all of embodiments known in themselves, and may be controlled, for example, in that the sensors 30 measure value, for example pressure or angular deviating exceeding a predetermined value. The values are communicated to the control device 28 which outputs a signal through electrical cables 31 to the actuator 27 opening the valve 23.

In a typical work situation drilling fluid is pumped down through the rotating drill string 14 out through several openings 17 in the drill bit 16. The drilling fluid cools the drill bit 16 and at the same time washes away the drilled cuttings. Well fluid and cuttings then return towards the surface through an annulus 4' formed between the drill string 14 and the well formation, and then further at reduced velocity due to the increase in diameter, through an annulus 3' formed between the drill string 14 and casing 3. As drilling proceeds and the length of the uncased well part 4 increases, the pressure of the drilling fluid must also be increased in order for the increased flow resistance to be overcome. At a specific pressure the drilling fluid will enter the formation and make it possible to maintain the same flow rate. Thus, according to known technique, the rate of the drilling fluid will have to be reduced, which makes settling of cuttings from the drilling fluid increase, especially at the transition shoe 5 where there is a reduction velocity. By opening of the valve 23 of the downhole valve 1, drilling fluid will exit the drill string 14 into the annulus 3' upstream of the drill bit. The drilling fluid flow rate may then be increased without an increase in the pressure worth mentioning, and settled cuttings are swept along by the drilling fluid and carried out of the well bore. As the downhole valve 1 is displaced past the transition shoe 5 into the uncased part 4 of the well, another downhole valve 1 which is positioned further up in the drill string 14 may open. The first downhole valve 1 may, if desired, be closed autonomously or from the surface.

The downhole valve enables a relatively quick out-circulation, and change of the specific gravity, of the drilling fluid at the upper portion of the well. This is of great importance when undesired situations arise in the well, with well fluid entering the well, or when drilling fluid enters the formation. As described above, the downhole valve is operative during the entire drilling operation and may be opened and closed any time without this causing interruption to the drilling itself.

A valve according to the invention will considerably improve the controllability of the hydraulic situation in a well, while at the same time the time for handling known well problems is reduced.

The invention claimed is:

1. A downhole valve device (1) in a drill string (14) in a petroleum well (2) for adjusting the annular fluid velocity and wellbore pressure, comprising a valve housing (20) having connection means for connecting the valve housing between adjacent segments (12, 13) of the drill string, the valve housing further comprising a longitudinal bore (22) forming an unimpeded fluid connection between the adjacent segments, the valve housing (20) being provided with at least one valve (23), located between longitudinal bore (22) and an annulus (3', 4') between the well (2) and the drill string (14), the valve (23) being caused to open and close to the flow of drilling fluid from the longitudinal bore (22) to the annulus (3', 4') between the well (2) and the drill string (14) by an actuator (27), said actuator (27) responding to a control device (28) connected to a sensor (30) that detects changes in downhole physical parameters or signals from the surface, the valve (23) of the downhole valve device (1) being further provided with means to permit even distribution of drilling fluid into the annulus.

2. The device according to claim 1, wherein the means for permitting even distribution of drilling fluid comprises a cylindrical distributor housing (25) having a plurality of openings (26) distributed along its periphery, said distributor housing being arranged coaxially with drill string (14) so as to form an annulus (24) between valve housing (20) and distributor housing (25) such that the fluid flowing through the valve (23) will enter annulus (24) and be evenly distributed into the well bore through openings (26).

3. A method for adjusting annular velocity of drilling fluid and well bore pressure in a petroleum well having a drilling string, the method comprising the steps of:

a. determining a desired range of annular velocity and pressure of the drilling fluid for a given well formation or drilling condition, b. actively measuring changes in the physical parameters in the well, c. venting, by the use of a valve device according to either of claims 1 or 2, in response to a detected change in the physical parameters in the well, or in response to a predetermined event, a sufficient volume of drilling fluid from inside the drilling string to an annulus formed between the drilling string and the well bore, for a sufficient amount of time, so as to adjust and maintain the annular velocity of the drilling fluid and the well bore pressure within the desired range.

4. The method according to claim 3, whereby the valve device is arranged in the drilling string at the vicinity of the drill bit.

5. The method according to claim 4, wherein, in addition to the valve device arranged in the vicinity of the drill bit, a plurality of valve devices are arranged at intervals along the length of the drill string.

* * * * *